US008070460B2

(12) United States Patent
Lee

(10) Patent No.: US 8,070,460 B2
(45) Date of Patent: Dec. 6, 2011

(54) OIL PUMP USED IN A LINEAR COMPRESSOR

(75) Inventor: Sangmin Lee, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 598 days.

(21) Appl. No.: 12/087,770

(22) PCT Filed: Jan. 16, 2007

(86) PCT No.: PCT/KR2007/000271

§ 371 (c)(1),
(2), (4) Date: Feb. 17, 2009

(87) PCT Pub. No.: WO2007/081195

PCT Pub. Date: Jul. 19, 2007

(65) Prior Publication Data

US 2009/0317263 A1 Dec. 24, 2009

(30) Foreign Application Priority Data

Jan. 16, 2006 (KR) ..... 10-2006-0004670

(51) Int. Cl.
*F04B 19/00* (2006.01)

(52) U.S. Cl. ..... 417/211; 417/362; 417/363; 417/417; 417/423.14

(58) Field of Classification Search ..... 417/211, 417/417, 61, 53, 363, 423.14
See application file for complete search history.

(56) References Cited

U.S. PATENT DOCUMENTS

| | | | | |
|---|---|---|---|---|
| 6,409,484 | B1 * | 6/2002 | Hyun | 417/417 |
| 7,264,451 | B2 * | 9/2007 | Park | 417/417 |
| 2004/0052658 | A1 * | 3/2004 | Lilie | 417/363 |
| 2004/0156732 | A1 * | 8/2004 | Lilie et al. | 417/417 |
| 2006/0257275 | A1 * | 11/2006 | Park | 417/417 |
| 2007/0104597 | A1 * | 5/2007 | Park et al. | 417/417 |
| 2009/0047154 | A1 * | 2/2009 | Choi et al. | 417/417 |

FOREIGN PATENT DOCUMENTS

| | | |
|---|---|---|
| CN | 1500183 | 5/2004 |
| CN | 1637291 | 7/2005 |
| KR | 10-2001-0081660 | 8/2001 |
| WO | WO 00/39461 | 7/2000 |
| WO | WO 02/081916 | 10/2002 |

* cited by examiner

*Primary Examiner* — Nimeshkumar D. Patel
*Assistant Examiner* — Jose M Diaz
(74) *Attorney, Agent, or Firm* — McKenna Long & Aldridge LLP

(57) ABSTRACT

The present invention discloses an oil supply apparatus of a linear compressor. In the linear compressor including a main body frame, a cylinder installed on the main body frame, and a piston installed inside the cylinder, for performing linear reciprocation, the oil supply apparatus circulates the oil between the cylinder and the piston. The oil supply apparatus of the linear compressor includes an oil supply passage for supplying the oil to a gap between the cylinder and the piston, and an oil pumping means consisting of an oil cylinder fixed to the main body frame to communicate with the oil supply passage, a mass member installed in the oil cylinder and linearly reciprocated by vibration of the main body frame, for pumping the oil, and oil elastic members installed in the oil cylinder, for elastically supporting the mass member at both sides of the mass member. A mass of the mass member and elastic moduli of the oil elastic members are set so that a natural frequency by the mass of the mass member and the elastic moduli of the oil elastic members can be smaller than an operating frequency of the main body frame.

6 Claims, 3 Drawing Sheets

[Fig. 1]
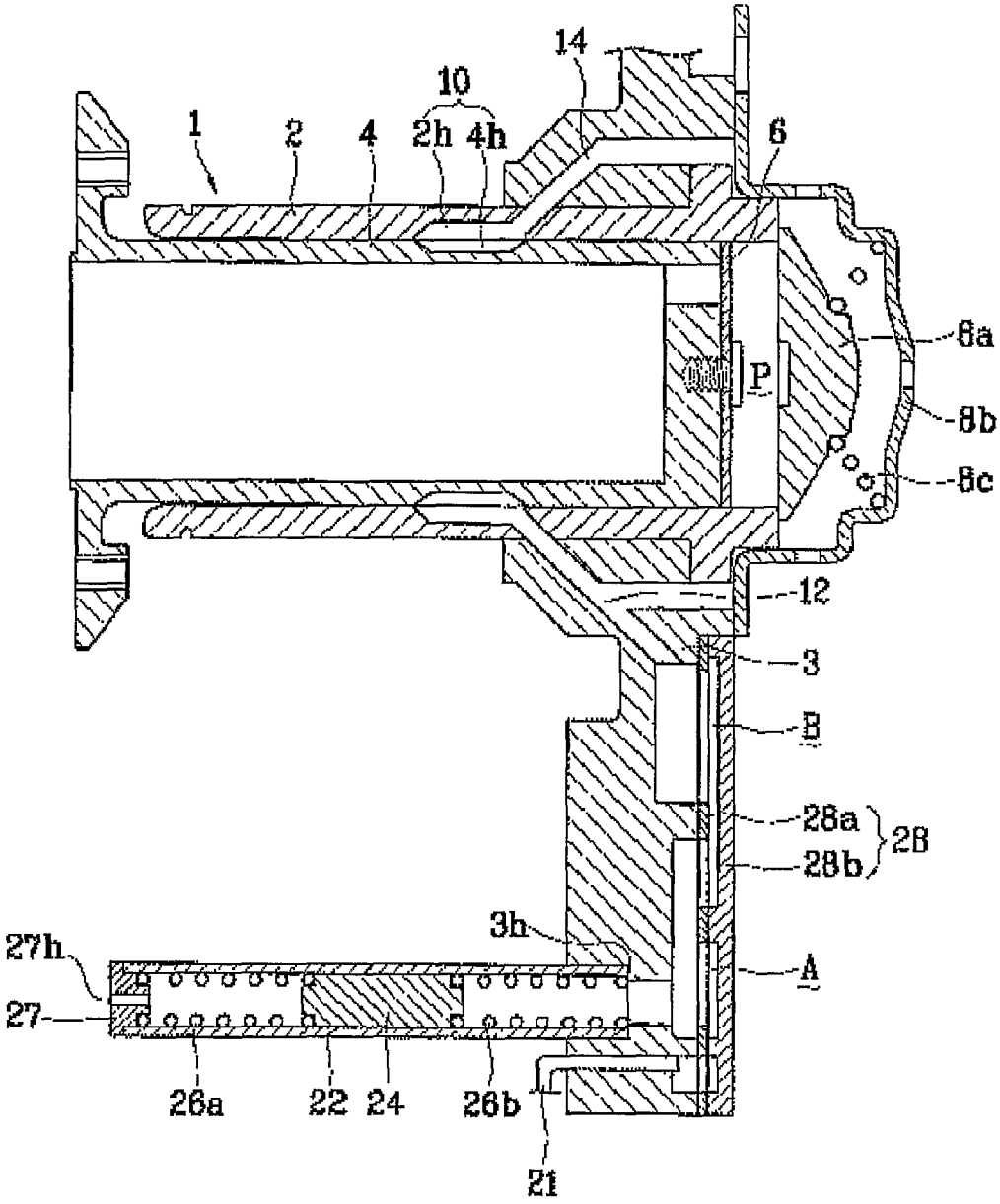

[Fig. 2]
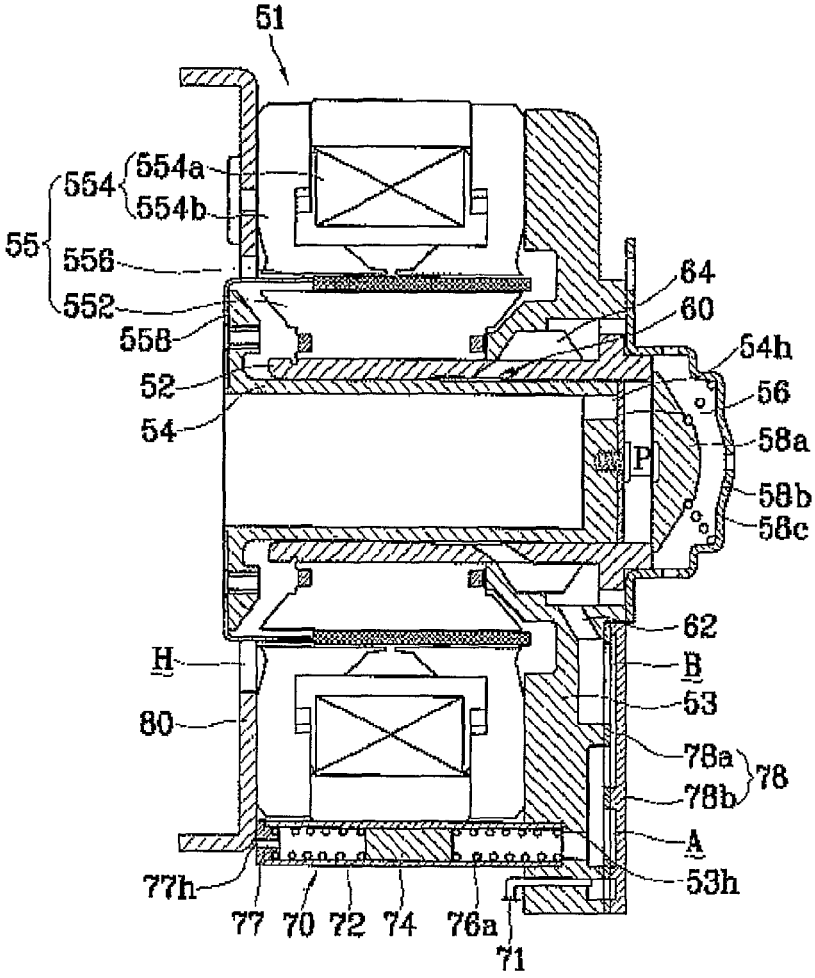
[Fig. 3]
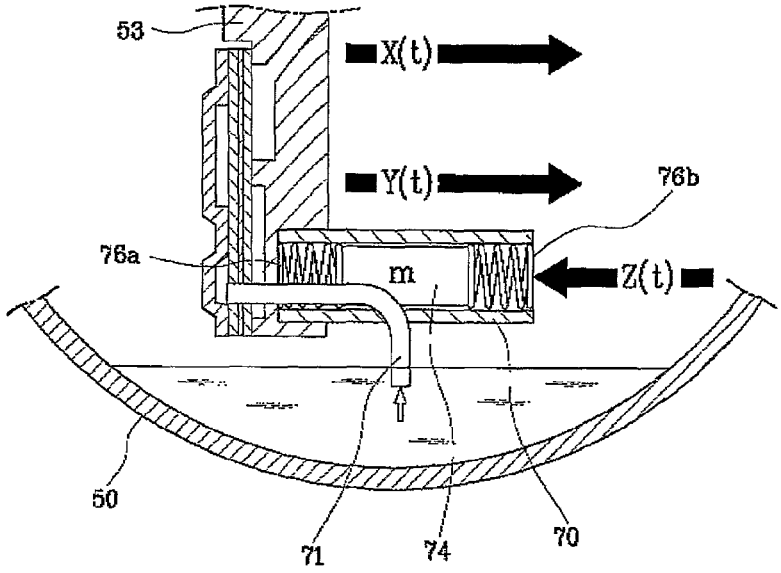

[Fig. 4]
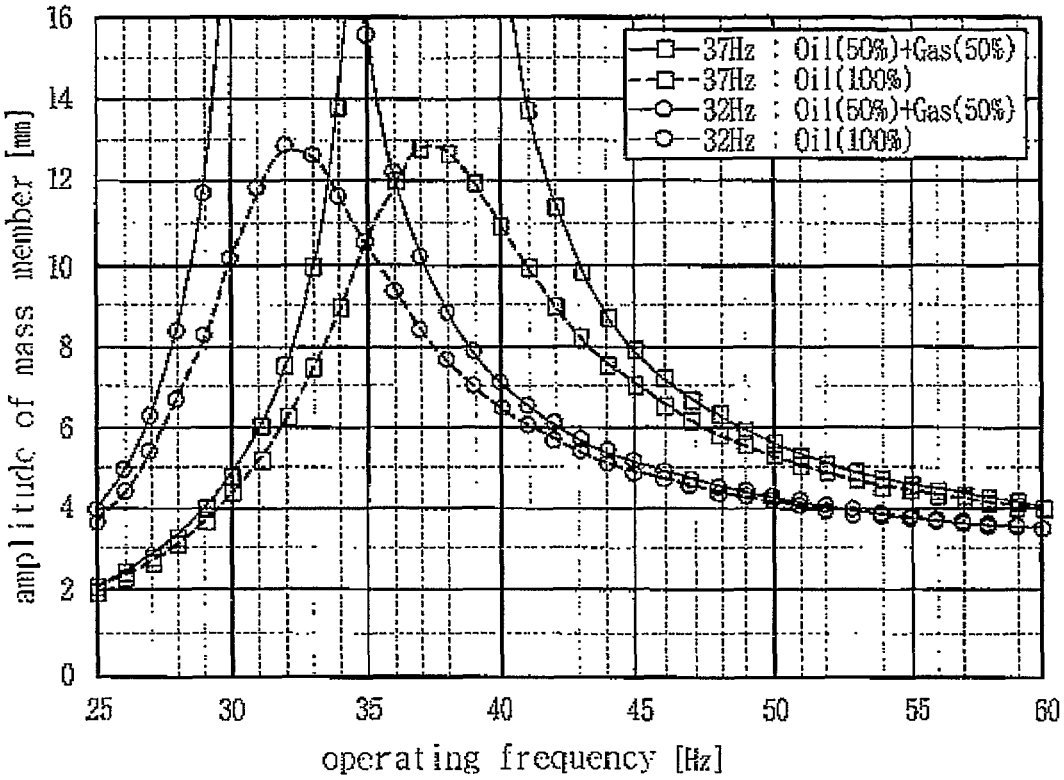

OIL PUMP USED IN A LINEAR COMPRESSOR

This application claims priority to International application No. PCT/KR2007/000271 filed on Jan. 16, 2007 which claims priority to Korean Application No. 10-2006-0004670 filed Jan. 16, 2006, both of which are incorporated by reference, as if fully set forth herein.

TECHNICAL FIELD

The present invention relates to an oil supply apparatus of a linear compressor which can pump the oil stored at a lower portion of a shell into a gap between a cylinder and a piston in a state where a structure including the cylinder, the piston and a linear motor is elastically installed inside the shell and the piston is linearly reciprocated inside the cylinder, and more particularly, to an oil supply apparatus of a linear compressor which can reduce abrasion by setting a natural frequency according to a mass member and oil springs for elastically supporting both ends of the mass member inside an oil cylinder to be smaller than an operating frequency of the linear compressor.

BACKGROUND ART

In general, a compressor is a mechanical apparatus for compressing the air, refrigerant or other various operation gases and raising a pressure thereof, by receiving power from a power generation apparatus such as an electric motor or turbine. The compressor has been widely used for an electric home appliance such as a refrigerator and an air conditioner, or in the whole industry.

The compressors are roughly classified into a reciprocating compressor in which a compression space for sucking or discharging an operation gas is formed between a piston and a cylinder, and the piston is linearly reciprocated inside the cylinder, for compressing a refrigerant, a rotary compressor in which a compression space for sucking or discharging an operation gas is formed between an eccentrically-rotated roller and a cylinder, and the roller is eccentrically rotated along the inner wall of the cylinder, for compressing a refrigerant, and a scroll compressor in which a compression space for sucking or discharging an operation gas is formed between an orbiting scroll and a fixed scroll, and the orbiting scroll is rotated along the fixed scroll, for compressing a refrigerant.

Recently, a linear compressor which can improve compression efficiency and simplify the whole structure without a mechanical loss resulting from motion conversion by connecting a piston directly to a linearly-reciprocated driving motor has been popularly developed among the reciprocating compressors.

In the linear compressor, the piston is linearly reciprocated in a cylinder by a linear motor inside a hermetic shell, for sucking, compressing and discharging a refrigerant. An oil supply apparatus for pumping the oil stored at the lower portion of the shell into a gap between the cylinder and the piston is provided to perform cooling and lubrication against the friction generated when the piston is linearly reciprocated inside the cylinder.

FIG. 1 is a cross-sectional view illustrating a conventional oil supply apparatus of a linear compressor.

Referring to FIG. 1, the conventional oil supply apparatus of the linear compressor is installed at a lower portion of a structure 1 disposed inside a hermetic shell (not shown) and comprised of a cylinder 2, a piston 4 and a linear motor (not shown). An oil supply passage 12 and an oil recovery passage 14 are formed in one side main body frame 3 to communicate with an oil circulation passage 10 formed between the cylinder 2 and the piston 4. A mass member 24 is elastically supported by oil springs 26*a* and 26*b* in an oil cylinder 22 formed at the lower portion of the oil supply passage 12 to communicate with the oil supply passage 12, and linearly reciprocated to generate a pressure difference. An oil supply tube 21 soaked in the oil stored at the lower portion of the shell is installed at one side of the oil cylinder 22 to communicate with the oil cylinder 22. An oil supply valve assembly 28 for controlling oil supply is installed between the oil supply passage 12 and the oil cylinder 22.

The main body frame 3 fixes the cylinder 2 and the linear motor. The piston 4 is linearly reciprocated between a top dead center (TDC) and a bottom dead center (BDC) inside the cylinder 2, for repeatedly performing a suction stroke for sucking a refrigerant into a compression space P formed between the piston 4 and the cylinder 2, and a compression stroke for compressing and discharging the refrigerant. A suction valve 6 for sucking the refrigerant is installed at an end of the piston 4, and a discharge valve 8*a* for discharging the compressed refrigerant is elastically supported and opened and closed by a discharge valve spring 8*c* inside a discharge cap 8*b* fixed to an end of the cylinder 2.

The oil supply passage 12 and the oil recovery passage 14 are formed in the main body frame 3 and the cylinder 2, for supplying and recovering the oil to/from the oil circulation passage 10 formed between the cylinder 2 and the piston 4. The oil circulation passage 10 is formed by a ring-shaped cylinder groove 2*h* of the inner circumference of the cylinder 2 and a ring-shaped piston groove 4*h* of the outer circumference of the piston overlapped with each other, for circulating the oil.

The oil cylinder 22 communicates with the end of the oil supply passage 12 at the lower portion of the structure 1 to be vibrated with the structure 1. The mass member 24 is linearly reciprocated inside the oil cylinder 22 due to an inertia force to the vibration of the oil cylinder 22. The oil springs 26*a* and 26*b* elastically support both ends of the mass member 24 in the axial direction, and generate the pressure difference in the oil cylinder 22. The oil supply tube 21 is installed at the lower portion of the oil cylinder 22 to communicate with the oil cylinder 22. The end of the oil supply tube 21 is soaked in the oil stored at the shell. In detail, an end of the oil cylinder 22 is fixedly inserted into a fixing groove 3*h* steppedly formed at the bottom end of the main body frame 3 communicating with the oil supply passage 12. A fixing cap 27 is forcibly inserted into the other end of the oil cylinder 22. Both ends of the mass member 24 are elastically supported by the oil springs 26*a* and 26*b* between the stepped fixing groove 3*h* of the oil supply passage 12 and the fixing cap 27, respectively. Here, an end of the fixing cap 27 is forcibly inserted into the other end of the oil cylinder 22, and the other end thereof is caught on the other end of the oil cylinder 22. That is, the fixing cap 27 is double stepped to be elastically supported by the oil spring 26*a*. A through hole 27*h* is formed at the center portion of the fixing cap 27. Accordingly, although the mass member 24 is linearly reciprocated in the oil cylinder 22, one side inner space of the oil cylinder 22 maintains the same pressure as the pressure inside the shell without a pressure difference.

The oil supply valve assembly 28 includes a plate-shaped valve sheet 28*a* installed at one side of the main body frame 3 communicating with the oil cylinder 22 and the oil supply passage 12, an oil suction valve (not shown) for sucking the oil and an oil discharge valve (not shown) for discharging the oil being installed on the valve sheet 28*a* to be opened and closed, and a sheet cover 28*b* installed outside the valve sheet 28*a* to overlap with the valve sheet 28*a*, for forming a suction storage space A and a discharge storage space B for temporarily storing the oil. Various components such as a gasket are additionally installed between the valve sheet 28*a* and the sheet cover 28*b*, for preventing leakage of the oil. In the conventional oil supply apparatus, when the oil cylinder 22 is vibrated with the structure 1, the mass member 24 is linearly reciprocated inside the oil cylinder 22 die to the inertia force to generate the pressure difference at one side inner space of the oil cylinder 22. Therefore, the oil stored at the lower portion of the shell is sucked into the oil supply tube 21, passed through the oil supply valve assembly 28*a* and 28*b*, supplied through the oil supply passage 12, circulated along the oil circulation passage 10 for cooling and lubrication, and recovered to the lower portion of the shell through the oil recovery passage 14.

The conventional oil supply apparatus of the linear compressor supplies the oil by vibration generated by an operating frequency of the main body frame 3 by linear reciprocation of the piston 4. When a natural frequency according to the oil springs 26*a* and 26*b* and the mass member 24 exists in a specific band, the mass member 24 is excessively moved to abrade support portions of the oil springs 26*a* and 26*b*.

DISCLOSURE OF INVENTION

Technical Problem

An object of the present invention is to reduce vibration and noise of an oil supply apparatus of a linear compressor and improve quality thereof, by setting a natural frequency of the oil supply apparatus not to cause abrasion.

Another object of the present invention is to improve durability of an oil supply apparatus of a linear compressor, and efficiently supply oil according to a smooth operation.

Technical Solution

There is provided an oil supply apparatus of a linear compressor including a refrigerant compression unit having a piston linearly reciprocated inside a cylinder, comprising: an oil supply passage for supplying the oil to a gap between the cylinder and the piston; an oil cylinder communicating with the oil supply passage; and a mass member installed in the oil cylinder and linearly reciprocated by the motion of the refrigerant compression unit, for pumping the oil, a natural frequency of the mass member being smaller than an operating frequency of the refrigerant compression unit. By this configuration, the natural frequency of the oil supply apparatus is equalized to the operating frequency of the refrigerant compression unit, thereby preventing resonance of the mass member.

In another aspect of the present invention, the natural frequency of the mass member is set to be smaller than the operating frequency of the refrigerant compression unit to prevent the mass member from performing a motion with an excessively large amplitude. This configuration prevents the oil supply apparatus from being abraded due to the excessively large amplitude of the mass member.

In another aspect of the present invention, the natural frequency of the mass member is set to be smaller than the operating frequency of the refrigerant compression unit by at least 20 Hz.

In another aspect of the present invention, the oil supply apparatus farther includes an oil spring for supporting the mass member in the oil cylinder, and the natural frequency is set in consideration of the oil spring. The oil filled in the oil cylinder is provided with elasticity in the motion of the mass member, and thus operated as a kind of elastic member. When the natural frequency of the mass member is computed in consideration of a modulus of elasticity of the oil, the mass member can be more precisely controlled.

In another aspect of the present invention, the oil supply apparatus further comprises oil springs for supporting both sides of the mass member in the oil cylinder and the natural frequency of the mass member considering the oil springs is set to be smaller than the operating frequency of the refrigerant compression unit by at least 20 Hz.

In another aspect of the present invention, a mass of the mass member is set so that the natural frequency can be smaller than the operating frequency of the refrigerant compression unit by at least 20 Hz.

In another aspect of the present invention, the oil supply apparatus further comprises oil springs for supporting both sides of the mass member in the oil cylinder, and moduli of elasticity the oil springs are set so that the natural frequency can be smaller than the operating frequency of the refrigerant compression unit by at least 20 Hz.

In addition, there is provided a control method of an oil supply apparatus of a linear compressor, the linear compressor including a refrigerant compression unit having a piston linearly reciprocated inside a cylinder, the oil supply apparatus including an oil supply passage, an oil cylinder and a mass member, comprising the steps of: setting an operating frequency of the refrigerant compression unit; and setting a natural frequency of the oil supply apparatus to be smaller than the operating frequency of the refrigerant compression unit in order to restrict excessive increase of an amplitude of the mass member.

In another aspect of the present invention, in the step of setting the natural frequency, the natural frequency of the oil supply apparatus is set to be smaller than the operating frequency of the refrigerant compression unit by at least 20 Hz.

In another aspect of the present invention, in the step of setting the natural frequency, the natural frequency is set in consideration of a modulus of elasticity of the oil in the oil cylinder and a mass of the mass member.

Advantageous Effects

In accordance with the present invention, the natural frequency of the oil supply apparatus of the linear compressor is set to prevent abrasion. As a result, vibration and noise of the oil supply apparatus of the linear compressor can be reduced and quality thereof can be improved.

In addition, durability of the oil supply apparatus of the linear compressor can be improved, and the oil can be efficiently supplied according to the smooth operation.

BRIEF DESCRIPTION OF THE DRAWINGS

The present invention will become better understood with reference to the accompanying drawings which are given only by way of illustration and thus are not limitative of the present invention, wherein:

FIG. 1 is a cross-sectional view illustrating a conventional oil supply apparatus of a linear compressor;

FIG. 2 is a cross-sectional view illustrating an oil supply apparatus of a linear compressor in accordance with the present invention;

FIG. 3 is a schematic view illustrating the oil supply apparatus of the linear compressor in accordance with the present invention; and FIG. 4 is a graph showing an operating frequency of the linear compressor and a natural frequency of the oil supply apparatus in accordance with the present invention.

MODE FOR THE INVENTION

The present invention will now be described in detail with reference to the accompanying drawings. The scope of the present invention is not limited to any of the details of the following description or the attached drawings. In addition, the scope of the present invention can be easily embodied by the ordinary people skilled in the art to which the present invention pertains. The right scope of the present invention is only limited by the claims as hereinafter recited.

FIG. 2 is a cross-sectional view illustrating an oil supply apparatus of a linear compressor in accordance with the present invention, FIG. 3 is a schematic view illustrating the oil supply apparatus of the linear compressor in accordance with the present invention, and FIG. 4 is a graph showing an operating frequency of the linear compressor and a natural frequency of the oil supply apparatus in accordance with the present invention.

As illustrated in FIGS. 2 and 3, in the oil supply apparatus of the linear compressor, an oil pumping means 70 is installed at a lower portion of a structure 51 including a cylinder 52, a piston 54 and a linear motor 55 in a shell 50 which is a hermetic space and, for pumping the oil stored at the lower portion of the shell 50 into each passage formed in the structure 51. A main body frame 53 and a motor cover 80 are installed to support both ends of the structure 51 and fix each component. An end of the oil pumping means 70 is fixed to the bottom end of the main body frame 53, and the other end thereof is partially supported by the bottom end of the motor cover 80.

An end of the piston 54 is linearly reciprocated inside the cylinder 52. A suction hole 54*h* is formed at an end of the piston 54, for sucking a refrigerant into a compression space P formed between the cylinder 52 and the piston 54. A thin suction valve 56 is installed at the end of the piston 54 to open and close the suction hole 54*h*. A discharge cover 58*a* is elastically supported and opened and closed by a discharge valve spring 58*c* inside a discharge cap 58*b* fixed to an end of the cylinder 52, for discharging the refrigerant compressed in the compression space P. A ring-shaped cylinder groove (not shown) and a ring-shaped piston groove (not shown) are formed on the inner circumference of the cylinder 52 and the outer circumference of the piston 54, respectively. The cylinder groove and the piston groove cooperate with each other, for forming an oil circulation passage 60 for circulating the oil.

The linear motor 55 includes an inner stator 552 formed by laminating a plurality of laminations in the circumferential direction, an outer stator 554 disposed around the cuter circumference of the inner stator 552 with intervals, including core blocks 554*b* formed by laminating a plurality of laminations being installed around a wound coil 554*a* at intervals, and a permanent magnet 556 disposed between the inner stator 552 and the outer stator 554, and linearly reciprocated by a mutual electromagnetic force. The permanent magnet 556 is connected directly to the other end of the piston 54 by a connection member 558, for driving the piston 54.

An end of the cylinder 52 is fixedly inserted into the center portion of the main body frame 53. An end of the outer stator 554 is supported by the surface of the main body frame 53 facing the cylinder 52. An oil supply passage 62 and an oil recovery passage 64 for supplying the oil to the oil circulation passage 60 and recovering the supplied oil are formed in the main body frame 53.

A hole H is formed at the center portion of the motor cover 80, so that the other end of the piston 54 can pass through the hole H. In a state where the other end of the outer stator 554 is supported by the surface of the motor cover 80 facing the cylinder 52, the circumference of the motor cover 80 is fixed to the main body frame 53 through the outer stator 554. Here, a plurality of springs (not shown) for elastically supporting the piston 54 in the axial direction are elastically supported by the surface of the motor cover 80 opposite to the cylinder 52.

The oil supply apparatus of the linear compressor includes the oil pumping means 70 and the oil supply passage 62. The oil pumping means 70 includes an oil cylinder 72 having an end settled in a stepped fixing groove 53*h* formed at the bottom end of the main body frame 53 to communicate with the oil supply passage 62, and having the other end disposed adjacently to the bottom end of the motor cover 80, a mass member 74 linearly reciprocated inside the oil cylinder 72, and oil elastic members 76*a* and 76*b* for elastically supporting both ends of the mass member 74 between the fixing groove 53*h* of the main body frame 53 and the bottom end of the motor cover 80, respectively.

The oil supply passage 62 includes an oil supply tube 71 having its bottom end soaked in the oil at the lower portion of the shell 50 to supply the oil, and its top end disposed to communicate with the oil cylinder 72. An oil supply valve assembly 78 for controlling oil supply is installed between the oil supply passage 62 and the oil cylinder 72. The oil supply valve assembly 78 includes a plate-shaped valve sheet 78*a* closely contacted to a side of the main body frame 53 communicating with the oil supply passage 62 where an oil suction valve (not shown) for sucking the oil and an oil discharge valve (not shown) for discharging the oil being formed to be opened and closed, and a sheet cover 78*b* installed outside the valve sheet 78*a* to overlap with the valve sheet 78*a,* for forming a suction storage space A and a discharge storage space B for temporarily storing the oil.

The oil cylinder 72 is formed in a cylindrical shape. An end of the oil cylinder 72 is fixedly inserted into the stepped fixing groove 53*h* formed on a surface of the bottom end of the main body frame 53, and the other end thereof is disposed adjacently to a surface of the motor cover 80. The oil cylinder 72 is installed at the right angle with the main body frame 53 and the motor cover 80. The mass member 74 having the same diameter as the inside diameter of the oil cylinder 72 is linearly reciprocated inside the oil cylinder 72 in the axial direction. An end of the mass member 74 is supported by the fixing groove 53*h* of the main body frame 53 through the first oil elastic member 76*a* which is a kind of compression spring, and the other end thereof is supported by the bottom end of the motor cover 80 through the second oil elastic member 76*b* which is a kind of compression spring.

The assembly process of the oil supply apparatus of the linear compressor in accordance with the present invention will now be described. The inner stator 552 is fixedly installed around the outer circumference of the cylinder 52, and an end of the cylinder 52 and an end of the outer stator 554 are installed on the main body frame 53 to be supported. In a state where an end of the piston 54 is inserted into the cylinder 52, the other end of the piston 54 is connected to the permanent magnet 556 disposed between the inner stator 552 and the outer stator 554. In a state where an end of the oil cylinder 72 is inserted into the fixing groove 53*h* of the main body frame 53, the first oil spring 76*a,* the mass member 74 and the second oil spring 76*b* are sequentially inserted into the other end of the oil cylinder 72, and the fixing cap 77 is inserted thereto.

The oil pumping means 70 pumps the oil by vibration generated in the main body frame 53. As shown in FIG. 3, when the motion state of the main body frame 53 is represented by a displacement X(t) in reference to the shell 50 and the motion state of the mass member 74 is represented by a displacement Y(t) in reference to the shell 50, the motion state of the mass member 74 is represented by a displacement Z(t)

in reference to the oil pumping means 70. The displacement and motion equation of the mass member 74 are represented as follows.

Displacement of the mass member 74: $Z(t)=X(t)-Y(t)$

Motion equation of the mass member 74:
$mZ+kZ=mX\omega^2 \sin(t)$

Displacement of the mass member 74: $Z(t)=\{mX^2/(k-m^2)\} \sin(t)=Z_p \sin(t)$

A natural frequency of the mass member 74 is determined according to a mass of the mass member 74 and moduli of elasticity of the oil elastic members 76*a* and 76*b*. Therefore, the mass of the mass member 74 and the moduli of elasticity of the oil elastic members 76*a* and 76*b* mist be changed to set the natural frequency.

FIG. 4 is a resonance graph using an operating frequency of the main body frame 53 as one axis and an amplitude of the mass member 74 as the other axis. The natural frequency according to the mass of the mass member 74 and the moduli of elasticity of the oil elastic members 76*a* and 76*b* is set to 32 or 37 Hz approximate to 40 Hz. According to the comparison result between the operating frequency of the linear compressor and the natural frequency of the mass member 74, if the natural frequency is smaller than the operating frequency by at least 20 Hz, excessive increase of the amplitude of the mass member 74 is prevented. In this embodiment, since the operating frequency is 60 Hz, the natural frequency is preferably smaller than at least 40 Hz.

The invention claimed is:

1. An oil supply apparatus of a linear compressor including a refrigerant compression unit having a piston linearly reciprocated inside a cylinder, the oil supply apparatus comprising:

an oil supply passage for supplying the oil to a gap between the cylinder and the piston;

an oil cylinder communicating with the oil supply passage: and a mass member installed in the oil cylinder and linearly reciprocated by the motion of the refrigerant compression unit, for pumping the oil, a natural frequency of the mass member being smaller than an operating frequency of the refrigerant compression unit, wherein the natural frequency of the mass member is set to be smaller than the operating frequency of the refrigerant compression unit by at least 20 Hz.

2. An oil supply apparatus of a linear compressor including a refrigerant compression unit having a piston linearly reciprocated inside a cylinder, the oil supply apparatus comprising:

an oil supply passage for supplying the oil to a gap between the cylinder and the piston;

an oil cylinder communicating with the oil supply passage:

a mass member installed in the oil cylinder and linearly reciprocated by the motion of the refrigerant compression unit, for pumping the oil, a natural frequency of the mass member being smaller than an operating frequency of the refrigerant compression unit; and oil springs for supporting both sides of the mass member in the oil cylinder, wherein the natural frequency of the mass member considering the oil springs is set to be smaller than the operating frequency of the refrigerant compression unit by at least 20 Hz.

3. An oil supply apparatus of a linear compressor including a refrigerant compression unit having a piston linearly reciprocated inside a cylinder, the oil supply apparatus comprising:

an oil supply passage for supplying the oil to a gap between the cylinder and the piston;

an oil cylinder communicating with the oil supply passage: and a mass member installed in the oil cylinder and linearly reciprocated by the motion of the refrigerant compression unit, for pumping the oil, a natural frequency of the mass member being smaller than an operating frequency of the refrigerant compression unit, wherein a mass of the mass member is set so that the natural frequency can be smaller than the operating frequency of the refrigerant compression unit by at least 20 Hz.

4. An oil supply apparatus of a linear compressor including a refrigerant compression unit having a piston linearly reciprocated inside a cylinder, the oil supply apparatus comprising:

an oil supply passage for supplying the oil to a gap between the cylinder and the piston:

an oil cylinder communicating with the oil supply passage;

a mass member installed in the oil cylinder and linearly reciprocated by the motion of the refrigerant compression unit, for pumping the oil, a natural frequency of the mass member being smaller than an operating frequency of the refrigerant compression unit; and oil springs for supporting both sides of the mass member in the oil cylinder, wherein moduli of elasticity of the oil springs are set so that the natural frequency can be smaller than the operating frequency of the refrigerant compression unit by at least 20 Hz.

5. A control method of an oil supply apparatus of a linear compressor, the linear compressor including a refrigerant compression unit having a piston linearly reciprocated inside a cylinder, the oil supply apparatus including an oil supply passage, an oil cylinder and a mass member, comprising the steps of:

setting an operating frequency of the refrigerant compression unit; and setting a natural frequency of the oil supply apparatus to be smaller than the operating frequency of the refrigerant compression unit so as to restrict excessive increase of an amplitude of the mass member, wherein, in the step of setting the natural frequency, the natural frequency of the oil supply apparatus is set to be smaller than the operating frequency of the refrigerant compression unit by at least 20 Hz.

6. A control method of an oil supply apparatus of a linear compressor, the linear compressor including a refrigerant compression unit having a piston linearly reciprocated inside a cylinder, the oil supply apparatus including an oil supply passage, an oil cylinder and a mass member, comprising the steps of:

setting an operating frequency of the refrigerant compression unit; and setting a natural frequency of the oil supply apparatus to be smaller than the operating frequency of the refrigerant compression unit so as to restrict excessive increase of an amplitude of the mass member, wherein, in the step of setting the natural frequency, the natural frequency is set in consideration of an elastic modulus of the oil in the oil cylinder and a mass of the mass member.

* * * * *